United States Patent [19]

Carlstedt

[11] Patent Number: 4,895,094

[45] Date of Patent: Jan. 23, 1990

[54] FENDER HANGER

[76] Inventor: Paul A. Carlstedt, 12545 3rd Ave. NW, Seattle, Wash. 98177

[21] Appl. No.: 252,217

[22] Filed: Sep. 30, 1988

[51] Int. Cl.[4] ..... B63B 21/04

[52] U.S. Cl. ..... 114/218; 114/364; 114/219

[58] Field of Search ..... 114/218, 219, 221 R, 114/364; 248/58, 61, 62, 63, 65, 74.1, 493; 24/129 R, 129 B, 129 A, 130

[56] References Cited

U.S. PATENT DOCUMENTS

| | | | |
|---|---|---|---|
| 3,042,353 | 7/1962 | O'Mara | 248/61 |
| 3,160,378 | 12/1964 | Goewey | 248/61 |
| 3,574,900 | 4/1971 | Emery | 114/218 |
| 3,575,371 | 4/1971 | Carlstedt | 248/215 |
| 3,650,236 | 3/1972 | McFarlane | 114/218 |
| 4,280,435 | 7/1981 | Loomis | 114/219 |
| 4,724,791 | 2/1988 | McSorley | 114/364 |

*Primary Examiner*—Sherman D. Basinger

*Assistant Examiner*—Stephen P. Avila

*Attorney, Agent, or Firm*—Ward Brown; Robert W. Beach

[57] ABSTRACT

A return bent clip of substantially rigid but resilient material has a flat back with apertures and a projecting tongue for adjustably securing the suspension cord of a boat fender. The front and back portions of the clip define a first recess sized and shaped to grip rigid tubular railings of a wide range of diameters. The return bent portion of the clip joining the front and back portions forms a separate smaller recess flared in width toward the first recess. The smaller recess is sized to receive smaller diameter lifelines of the type commonly used on sailboats. The clip can be selectively fitted over a large diameter railing or a small diameter lifeline. The snug friction fit of the clip on the railing or lifeline deters longitudinal sliding movement of the clip along the railing or lifeline so that the fender suspended from the clip is reliably positioned.

21 Claims, 1 Drawing Sheet

FENDER HANGER

BACKGROUND OF THE INVENTION

1. Field of the Invention

The present invention relates to a hanger in the form of a clip detachably connectable to a boat, such as to a railing, a cleat or a lifeline, and adapted to secure a cord or line by which a boat fender is suspended.

2. Prior Art

A fender hanger of the general type with which the present invention is concerned was disclosed in my U.S. Pat. No. 3,575,371, issued Apr. 20, 1971. Such patent is expressly incorporated by reference herein. The prior fender hanger was in the form of a clip having a return bent body. One side of the body was flat and adapted to receive the suspension cord of a boat fender so that the effective length of the suspension cord could be adjusted. The other side of the clip body had transversely spaced legs joined to the flat side by an arcuate return bent section of gradual curvature.

The prior fender hanger was particularly convenient for a detachable connection to a cleat, such as shown in FIG. 4 of U.S. Pat. No. 3,575,371, or to a horizontal railing in the area of an upright post, as shown in FIG. 3 of the patent. The neck of the cleat or the post for the railing would fit between the transversely spaced legs and prevent sliding movement of the clip along the cleat or railing. When fitted over an intermediate section of railing between posts, the prior hanger could slide longitudinally of the railing, particularly if the railing was of small diameter. Similarly, the prior hanger would slide freely along the small diameter lifelines or cables commonly used on sailboats.

Loomis U.S. Pat. No. 4,280,435, issued Aug. 11, 1978, discloses a modified fender hanger including a return bent portion that may be fitted over "a rope, line, pole, etc. associated with the boat deck or other portion of a boat from which the boat fender is to be suspended" (column 3, lines 26 to 28). Similar to my previous hanger shown in U.S. Pat. No. 3,575,371, the Loomis hanger is free to slide along the supporting member.

SUMMARY OF THE INVENTION

The principal object of the present invention is to provide an improved fender hanger of the general type disclosed in my prior U.S. Pat. No. 3,575,371 but modified to adapt such hanger for more convenient and reliable use in new environments, particularly on long railings and lifelines of a wide range of diameters.

In the preferred embodiment of the present invention, the foregoing object is accomplished by providing a fender hanger in the form of a return bent clip having a generally flat back with apertures and a projecting tongue for adjustably securing the suspension cord of a boat fender, and a front portion with transversely spaced legs resiliently biased toward the back, similar to the hanger disclosed in my prior patent. In the modified hanger, however, the channel between the front and back portions of the clip defines a first recess sized and shaped to grip rigid tubular railings of a wide range of diameters. The snug frictional engagement of a railing in such recess deters sliding movement of the clip longitudinally of the railing.

In the preferred embodiment, such first recess is defined by the inner surface of the back portion of the clip, the inner surface of the front portion and an upper portion disposed substantially at right angles to the front and back portions. A tubular railing is engaged against the front, back and top portions along three circumferentially spaced lines of contact for the snug friction fit.

In the modified clip, the channel between the front and back portions also defines a second, much narrower recess or groove that opens into the first recess. Such second recess flares in width toward the first recess and is sized to receive lifelines of the type commonly used on sailboats. Smaller diameter lifelines fit more deeply into the flared recess than larger diameter lifelines, but in each case the lifeline can be manually wedged inward for a snug friction fit. Since the lifelines often have a slick outer sheath, preferably the flared recess is provided with grip-promoting ribs or ridges or a high-friction grip-promoting inner layer to deter sliding movement of the clip longitudinally of the lifeline.

Preferably, the second recess extends upward from the first recess with one flat side formed by the upper portion of the back of the clip. The front portion of the second recess is disposed at a small acute angle to the back portion.

DETAILED DESCRIPTION

Figures 1, 2, 3, 4, 5:
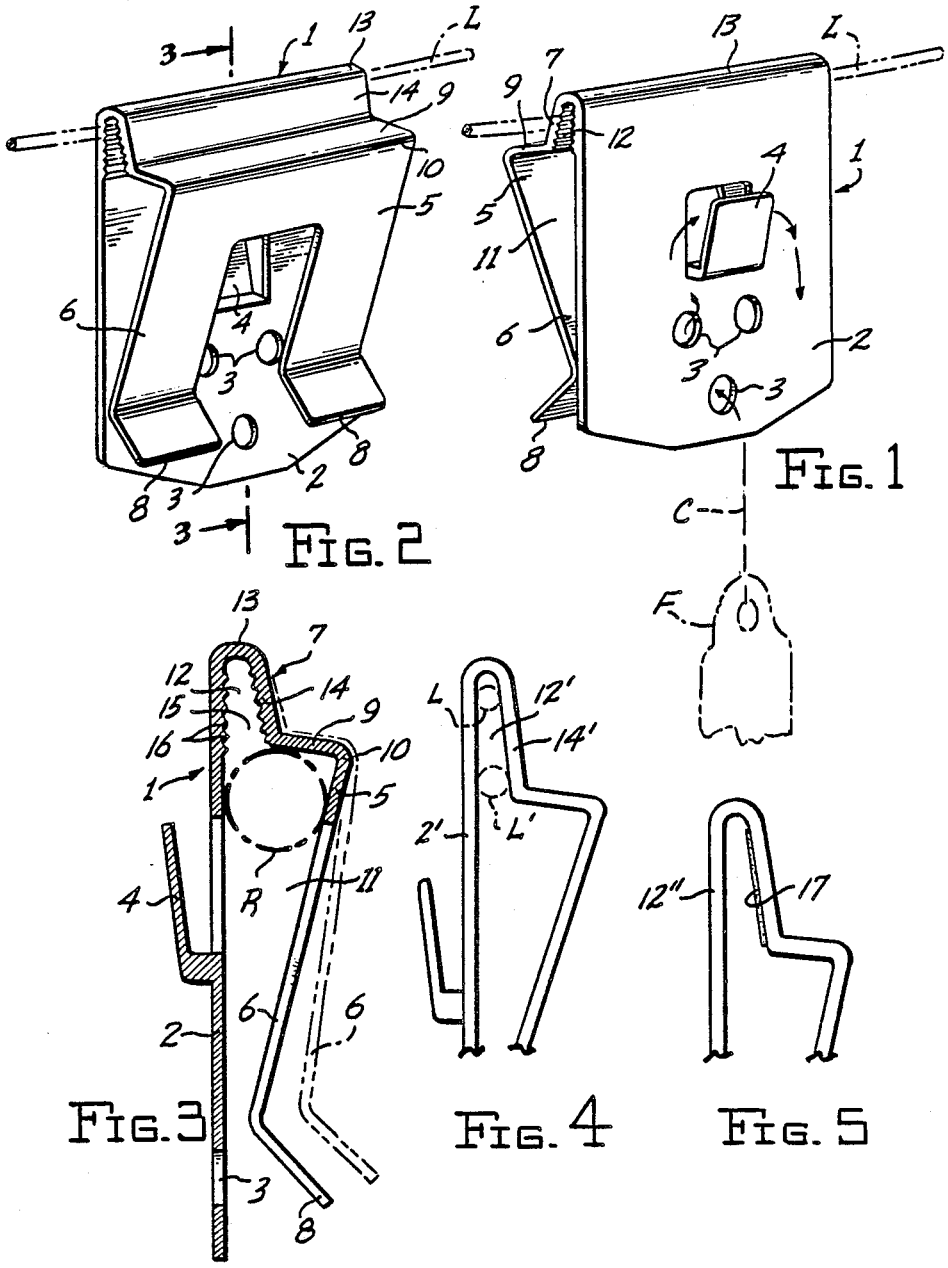
FIG. 1 is a somewhat diagrammatic top rear perspective of a fender hanger in accordance with the present invention.
FIG. 2 is a corresponding top front perspective thereof.
FIG. 3 is a transverse vertical section along line 3—3 of FIG. 2.
FIG. 4 is a fragmentary side elevation of the upper portion of a modified fender hanger in accordance with the present invention.
FIG. 5 is a fragmentary side elevation of the upper portion of another modified form of fender hanger in accordance with the present invention.

With reference to FIGS. 1 and 2, a fender hanger in accordance with the present invention can have several features in common with the hanger ("Rope-Mounting Bracket") of my U.S. Pat. No. 3,575,371. The hanger is in the form of a return bent clip 1 of substantially rigid but resilient material such as a suitable plastic. The back 2 of the clip can be planar with apertures 3 and a projecting tongue or prong 4 extending outward then upward above the apertures 3. The line or cord C by which a boat fender F is suspended can be threaded through the apertures 3 and inserted in front of the tongue or prong 4 to secure the cord to the clip as indicated diagrammatically in FIG. 1.

The front portion 5 of the clip 1 has transversely spaced legs 6 joined to the back 2 by an upper joining section 7 having a return bend. In the relaxed condition of the clip illustrated in FIGS. 1 and 2, the legs 6 extend downward and rearward into contact with the inner surface of the back 2 and from that location are inclined downward and outward to their bottom free ends 8 forming an open mouth for reception of a railing, cleat or the like.

As thus far described, the construction of the hanger in accordance with the present invention is substantially the same as the construction of the hanger shown in my previous patent. The clip 1 can be conveniently fitted over a cleat, for example, in which case the oppositely projecting arms of the cleat wedge the legs 6 away from the back 2 and the upright neck of the cleat is received in the space between the clip legs 6. Similarly, the clip can be fitted over a rigid tubular horizontal railing in the area of an upright post, as shown in FIG. 3 of my previous patent, in which case the post is received in the space between the legs 6.

In the previous construction, however, the return bent upper portion of the clip was gradually curved in a circular arc from the back of the clip to the front. The clip still could be fitted over an intermediate section of horizontal railing, but the clip could slide lengthwise of the railing, particularly if the railing was of small diameter. Similarly, the prior clip was not convenient for attachment along an intermediate section of a lifeline of the type commonly used in sailboats so as to reliably position a boat fender at a desired location.

In accordance with the present invention, the shape of the upper portion of the clip 1 has been modified to accommodate standard railings and lifelines. As best seen in FIG. 3, the back 2 of the clip can be substantially planar but, contrary to my previous construction, the upper portions of the legs 6 above their point of engagement or closest approach to the back 2 also can be planar rather than being curved. Each leg extends substantially linearly upward and outward relative to the back 2 to an upper transitional or ledge portion 9 extending substantially perpendicularly to the legs 6 and joined thereto by an abrupt, substantially right angle bend 10. The inner surfaces of the back 2, legs 6 and upper portion 9 define a first recess 11 of generally right triangular cross section for receiving a standard rigid tubular railing R of a boat. The triangle of cross section includes a base defined by the back 2 at least several times longer than the side defined by the plane of portion 9.

The clip 1 can be conveniently fitted downward over the railing, thereby wedging the legs 6 outward away from the back 2 of the clip to approximately the position shown in broken lines in FIG. 3. As the clip is slid downward over the railing, the legs 6 spring back toward the back 2 to a greater or lesser degree depending on the diameter of the railing R which fits in the upper portion of the recess.

As compared to the arrangement shown in my prior patent in which the upper portion of the hanger is gradually curved around the railing, in the modified clip 1 the railing R is engaged against the front portion 5, upper portion 9 and back 2 of the clip along three circumferentially spaced lines of contact for a snug friction fit which deters sliding movement of the clip longitudinally of the railing R and therefore positions the suspended boat fender more reliably at a desired position.

The preferred clip 1 in accordance with the present invention has a second recess or groove 12 sized to receive a much smaller diameter lifeline L of the type commonly used on sailboats. In the preferred embodiment, such second recess is defined by the upper portion of the back 2 of the clip 1, the sharply return bent top 13 and a downward and outward inclined portion 14 joined to the inner edge of the ledge 9. As best seen in FIG. 3, the return bent top 13 is positioned at the opposite side of the clip from the open mouth defined by the bottom free ends of the legs 6, providing a hinge-like point of flexure at a position spaced above the top of the first recess 11. The legs 6 swing about such flexure point, such as from the solid line position shown in FIG. 3 to the broken line position, to accommodate a wide range of railing diameters without excessively deforming the relationship between the front, back and ledge portions of the hanger. The second recess 12 is flared in width downward to the location where it opens into the first recess 11. The planar upright portion 14 defining the front side of recess 12 is disposed at a small acute angle to the back 2 of the clip which defines the rear side of such recess. In combination with the opening 15 of the second recess into the first recess, the second recess 12 also is of substantially right triangular cross section, but with the right angle disposed at the bottom of the recess as compared to the first recess 11 which has the right angle at the top, and the ledge 9 forms an abrupt step between the first and second recesses adjacent to the opening of the second recess into the first recess.

Sailboat lifelines often have a slippery sheath and, consequently, preferably some grip-promoting mechanism is provided. In the embodiment illustrated in FIGS. 1, 2 and 3, the opposite sides of the second recess 12 are provided with grip-promoting ribs or ridges 16 that extend transversely of the clip 1. In the absence of grip-promoting mechanism, the length of the top recess can be increased to be several times its maximum width as for the recess 12' illustrated in FIG. 4. In that modified form, the angle of the back 2' to the modified front portion 14' is reduced and the overall length of the clip is increased so that approximately the same snug friction fit can be achieved for a lifeline L or L' by manually wedging the lifeline tightly into the more gradually tapered recess 12'. The increase in height of the upper portion of the clip is undesirable so that, as shown in FIG. 5, a more desirable alternative is to provide a different type of grip-promoting mechanism such as strips or a pad 17 of high-friction material along at least one side of the second recess 12''. Nevertheless, the embodiment illustrated in FIGS. 1, 2 and 3 is preferred.

In a representative embodiment, the clip 1 would be positioned as shown in solid lines in FIG. 3 for a rigid railing of a diameter of about ¾ inch but would accommodate larger diameter railings. The upper recess 12 can be sized to receive a plastic-coated steel cable of a diameter of about 5/32 inch snugly in the tip portion of the recess and a lifeline cable approximately twice that diameter in the bottom portion of the recess adjacent to the opening into the first recess 11.

I claim:

1. A marine hanger for attachment to a railing or the like comprising a clip having a back portion and a front portion resiliently biased toward said back portion, said front and back portions forming a first recess there between for reception of the railing or the like engaged between said front and back portions, said clip including a portion integral with and joining said front portion and said back portion, said joining portion forming a second recess opening into said first recess, said second recess being of substantially triangular cross section and having a maximum width much smaller than the maximum width of the first recess.

2. The hanger defined in claim 1, in which at least one side of the second recess has grip-promoting projections extending into the second recess.

3. The hanger defined in claim 1, in which the second recess has opposite sides each having grip-promoting ridges extending transversely of the clip.

4. The hanger defined in claim 1, including an abrupt step between the first and second recesses adjacent to the opening of the second recess into the first recess.

5. The hanger defined in claim 1, in which the first recess has an open mouth at one side thereof for passage of a railing or the like into the first recess through said mouth, the joining portion being positioned at the opposite side of the first recess from said mouth and having a return bend forming a point of flexure for relative movement of the front and back portions which point of flexure is spaced from the first recess.

6. A marine hanger for attachment to a railing or the like comprising a clip having a back portion and a front portion resiliently biased toward said back portion, said front and back portions forming a first recess there between for reception of the railing or the like engaged between said front and back portions, said clip including a portion integral with and joining said front portion and said back portion, said joining portion forming a second recess opening into said first recess, said second recess being flared in width toward said first recess for reception of a lifeline or the like.

7. The hanger defined in claim 6, in which at least one side of the second recess has grip-promoting projections extending into the second recess.

8. The hanger defined in claim 6, in which the second recess has opposite sides each having grip-promoting ridges extending transversely of the clip.

9. The hanger defined in claim 6, including an abrupt step between the first and second recesses adjacent to the opening of the second recess into the first recess.

10. The hanger defined in claim 6, in which the first recess has an open mouth at one side thereof for passage of a railing or the like into the first recess through said mouth, the joining portion being positioned at the opposite side of the first recess from said mouth and having a return bend forming a point of flexure for relative movement of the front and back portions which point of flexure is spaced from the first recess.

11. A marine hanger for attachment to a railing or the like comprising a clip having a back portion and a front portion resiliently biased toward said back portion, said front and back portions forming a first recess there between for reception of the railing or the like engaged between said front and back portions, said clip including a portion integral with and joining said front portion and said back portion, said joining portion forming a second recess opening into said first recess, at least one side of said second recess having grip-promoting projections extending into said second recess.

12. The hanger defined in claim 11, including an abrupt step between the first and second recesses adjacent to the opening of the second recess into the first recess.

13. The hanger defined in claim 12, in which the first recess has an open mouth at one side thereof for passage of a railing or the like into the first recess through said mouth, the joining portion being positioned at the opposite side of the first recess from said mouth and having a return bend forming a point of flexure for relative movement of the front and back portions which point of flexure is spaced from the first recess.

14. A marine hanger for attachment to a railing or the like comprising a clip having a back portion and a front portion resiliently biased toward said back portion, said front and back portions forming a first recess there between for reception of the railing or the like engaged between said front and back portions, said clip including a portion integral with and joining said front portion and said back portion, said joining portion forming a second recess opening into said first recess, said second recess having opposite sides each having grip-promoting ridges extending transversely of said clip.

15. The hanger defined in claim 14, including an abrupt step between the first and second recesses adjacent to the opening of the second recess into the first recess.

16. The hanger defined in claim 14, in which the first recess has an open mouth at one side thereof for passage of a railing or the like into the first recess through said mouth, the joining portion being positioned at the opposite side of the first recess from said mouth and having a return bend forming a point of flexure for relative movement of the front and back portions which point of flexure is spaced from the first recess.

17. A marine hanger for attachment to a boat railing, a lifeline or the like comprising a one-piece clip having a front portion, a back portion and a portion joining said front portion and said back portion and including a return bend, said front, back and joining portions defining two pairs of converging planes flaring in opposite directions and defining first and second recesses, respectively.

18. A marine hanger for selective attachment to elongated lengths of different cross-sectional sizes comprising, a clip having first and second portions resiliently biased toward each other and forming an open mouth for insertion of a selected elongated length through said mouth between said first and second portions, said clip including a third portion joining said first and second portions, said first, second and third portions of said clip forming a recess opening to the exterior of said clip through said mouth, said recess having a first section for grasping of an elongated length of a first range of cross-sectional sizes in said first section and a second section opening into said first section and flared in width toward said first section for grasping of an elongated length of a second range of cross-sectional sizes, smaller than said first range, in said second recess section by insertion through said mouth and through said first recess section prior to passage into said second recess section.

19. The hanger defined in claim 18, in which the second recess section is formed in the third portion of the clip.

20. The hanger defined in claim 19, in which the third portion is positioned at the opposite side of the first recess from the open mouth and has a return bend forming a point of flexure for relative movement of the first and second portions which point of flexure is spaced from the first recess section.

21. The marine hanger defined in claim 18, including an abrupt step between the first and second recess sections adjacent to the opening of the second recess section into the first recess section.

* * * * *